US009508271B2

(12) United States Patent
Chen

(10) Patent No.: US 9,508,271 B2
(45) Date of Patent: Nov. 29, 2016

(54) ELECTRONIC BOLT SEAL

(71) Applicant: Chih-Chuan Chen, Nantou (TW)

(72) Inventor: Chih-Chuan Chen, Nantou (TW)

( * ) Notice: Subject to any disclaimer, the term of this patent is extended or adjusted under 35 U.S.C. 154(b) by 125 days.

(21) Appl. No.: 14/568,116

(22) Filed: Dec. 12, 2014

(65) Prior Publication Data

US 2016/0168877 A1 Jun. 16, 2016

(51) Int. Cl.
*G08B 13/14* (2006.01)
*G09F 3/03* (2006.01)

(52) U.S. Cl.
CPC ..... *G09F 3/0317* (2013.01); *G09F 3/0329* (2013.01); *G09F 3/0335* (2013.01)

(58) Field of Classification Search
CPC ..... E05B 85/00; E05B 77/00; E05B 45/005; G09F 3/0317; G09F 3/0376; G09F 3/0329; G08B 13/08; G08B 13/126
USPC ..... 340/572.8, 426.1, 426.12, 427
See application file for complete search history.

(56) References Cited

U.S. PATENT DOCUMENTS

| | | | | |
|---|---|---|---|---|
| 6,069,563 | A * | 5/2000 | Kadner | G08B 13/06 340/539.1 |
| 6,764,114 | B1 * | 7/2004 | Guillon | G07C 7/00 292/307 R |
| 2008/0094224 | A1 * | 4/2008 | Parker | B65F 1/1646 340/572.8 |
| 2009/0091144 | A1 * | 4/2009 | Debrody | G09F 3/0317 292/327 |
| 2010/0013635 | A1 * | 1/2010 | Berger | G08B 13/08 340/542 |
| 2010/0214077 | A1 * | 8/2010 | Terry | E05B 39/02 340/10.4 |
| 2012/0119975 | A1 * | 5/2012 | Lee | H01Q 1/2208 343/905 |

* cited by examiner

*Primary Examiner* — Sam K Ahn
*Assistant Examiner* — Fabricio R Murillo Garcia
(74) *Attorney, Agent, or Firm* — Raymond Y. Chan; David and Raymond Patent Firm

(57) ABSTRACT

The present invention teaches a tamper-proof electronic bolt seal which contains a bolt assembly and a seal body. The gist of the present invention lies in the bolt assembly which contains a casing, and a circuit board elastically suspended inside the casing. When a burglar grinds a bolt head of the casing, an internal circuit of the electronic bolt seal is automatically disrupted so that the tampering of the electronic bolt seal can be detected.

11 Claims, 8 Drawing Sheets

ELECTRONIC BOLT SEAL

TECHNICAL FIELD OF THE INVENTION

The present invention is generally related to electronic bolt seals, and more particular to a tamper-proof electronic bolt seal.

DESCRIPTION OF THE PRIOR ART

FIG. 1 depicts a conventional electronic bolt seal 90 which contains a bolt 91 and a seal body 92. A radio-frequency identification (RFD) chip is configured in the bolt 91 whereas an antenna is configured in the seal body 92. By pushing the bolt 91 through a door latch 93 into the seal body 92, a container 94 is secured. As the bolt 91 contacts the antenna inside the seal body 92, the bolt 91 becomes an external antenna. A reader is used to send an electromagnetic wave which is received by the external antenna of the electronic bolt seal 90. The RFID chip then turns the power of the electromagnetic wave into an electric voltage and uses the electronic voltage to modulate and radiate an identification code of the RFID chip into an electromagnetic wave through the external antenna. The reader receives and demodulates the electromagnetic wave, and obtains the identification code. Through the identification code, customs can learn the identification of the container so as to achieve automatic identification and management. In addition, if a burglar tries to steal the cargo inside the container and cuts the bolt 91, customs can be altered through the identification electromagnetic wave.

However, as shown in FIG. 2, a burglar can use a grinding wheel 95 to grind the bolt head 911 of the bolt 91 so that its diameter is smaller than that of the latch hole 931 of the door latch 93. Then the electronic bolt seal 91 can be removed from the door latch 93 without being damaged. After stealing the container 94's cargo, the burglar simply plugs the electronic bolt seal 90 upside down back into the latch hole 931 and the customs is not alerted.

SUMMARY OF THE INVENTION

The present invention provides a tamper-proof electronic bolt seal. The gist of the present invention lies in the bolt assembly which contains a casing, and a circuit board installed inside the casing. When a burglar grinds a bolt head of the casing, an internal circuit of the electronic bolt seal is automatically disrupted so that the tampering of the electronic bolt seal can be detected.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
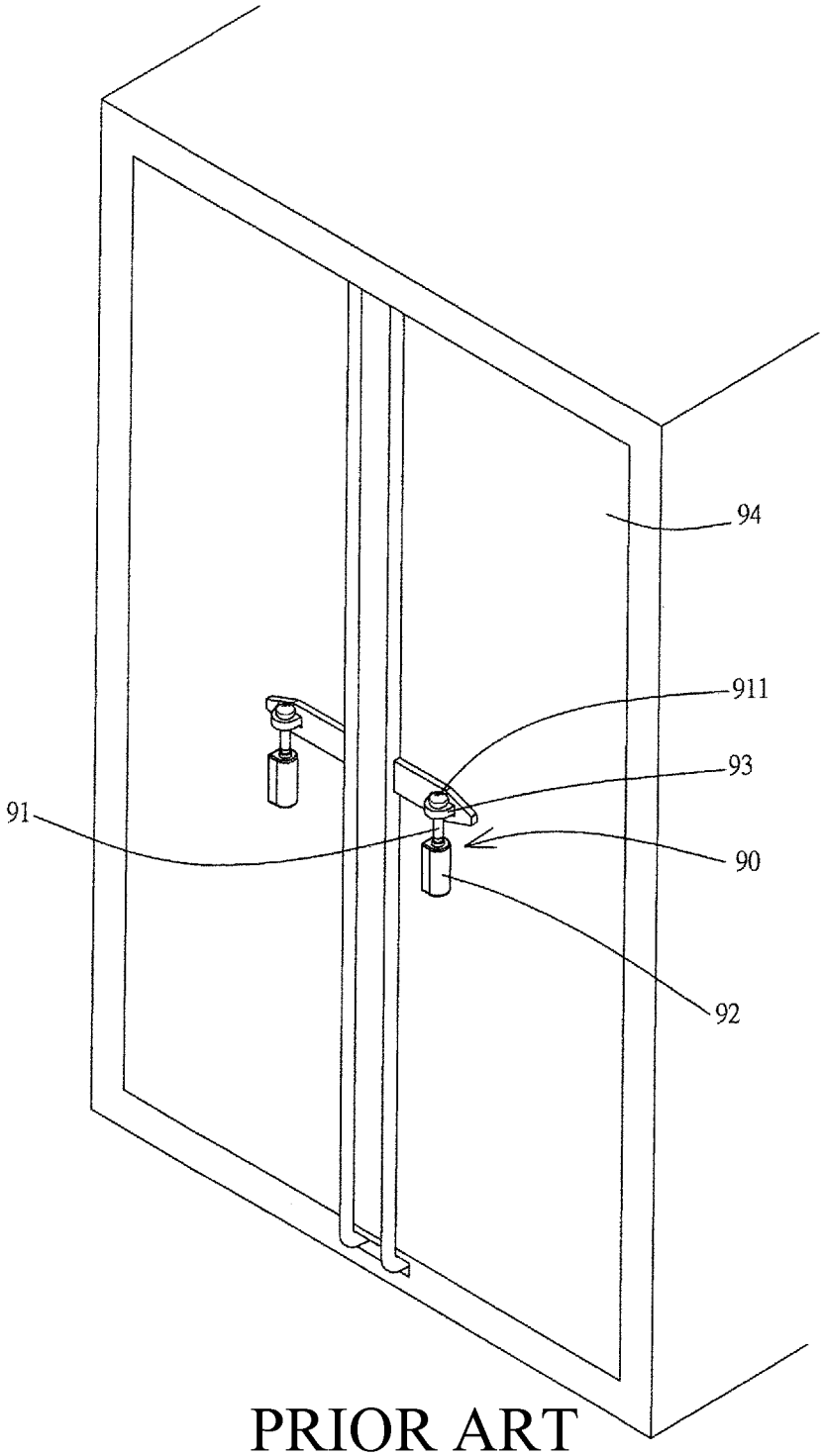
PRIOR ART FIG. 1
FIG. 1 is a schematic diagram showing a conventional electronic bolt seal securing a container.
Figure 2:
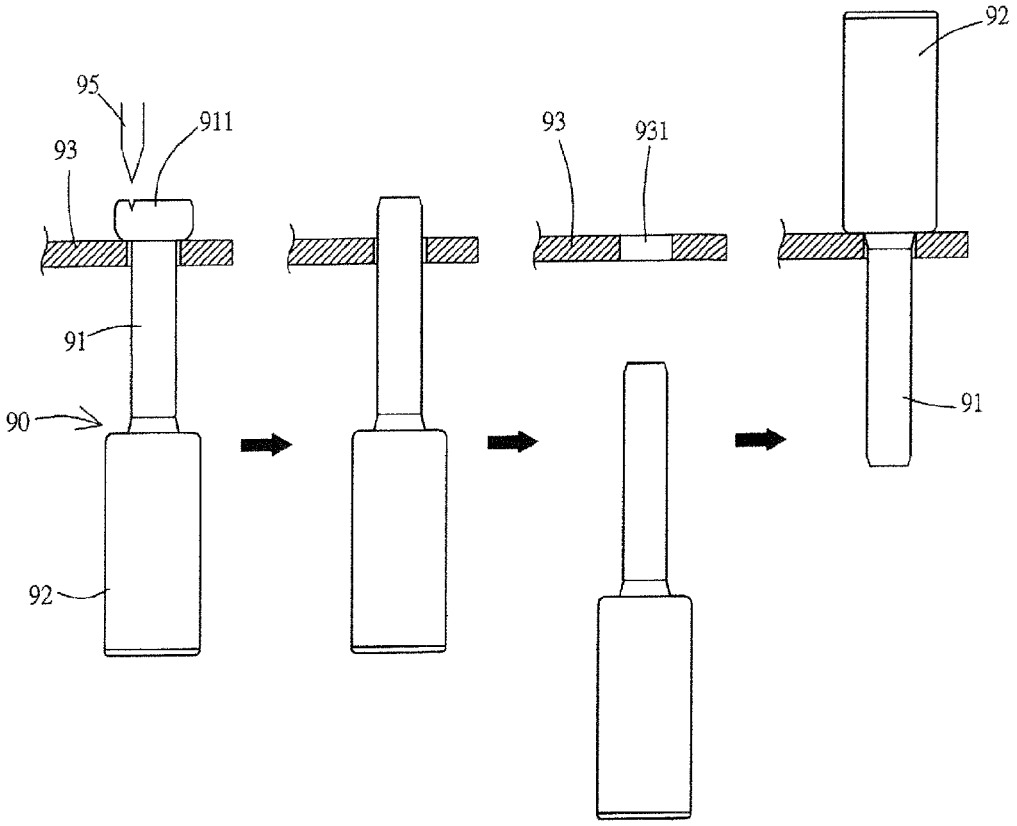
PRIOR ART FIG. 2
FIG. 2 is a schematic diagram showing the scenario of tampering a conventional electronic bolt seal.
Figure 3:
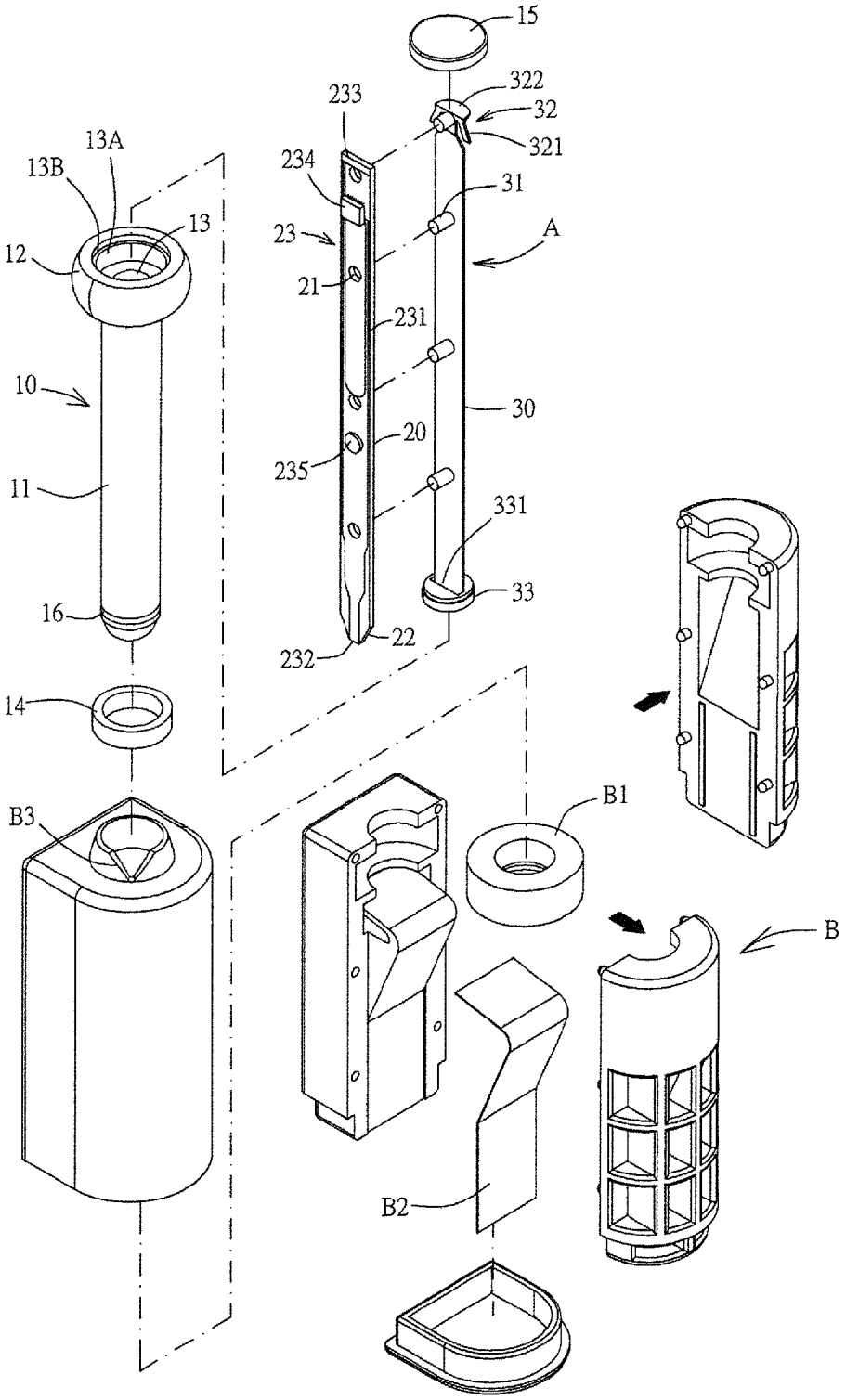
FIG. 3 is a perspective break-down diagram showing the various components of an electronic bolt seal according to an embodiment of the present invention.
Figure 4:
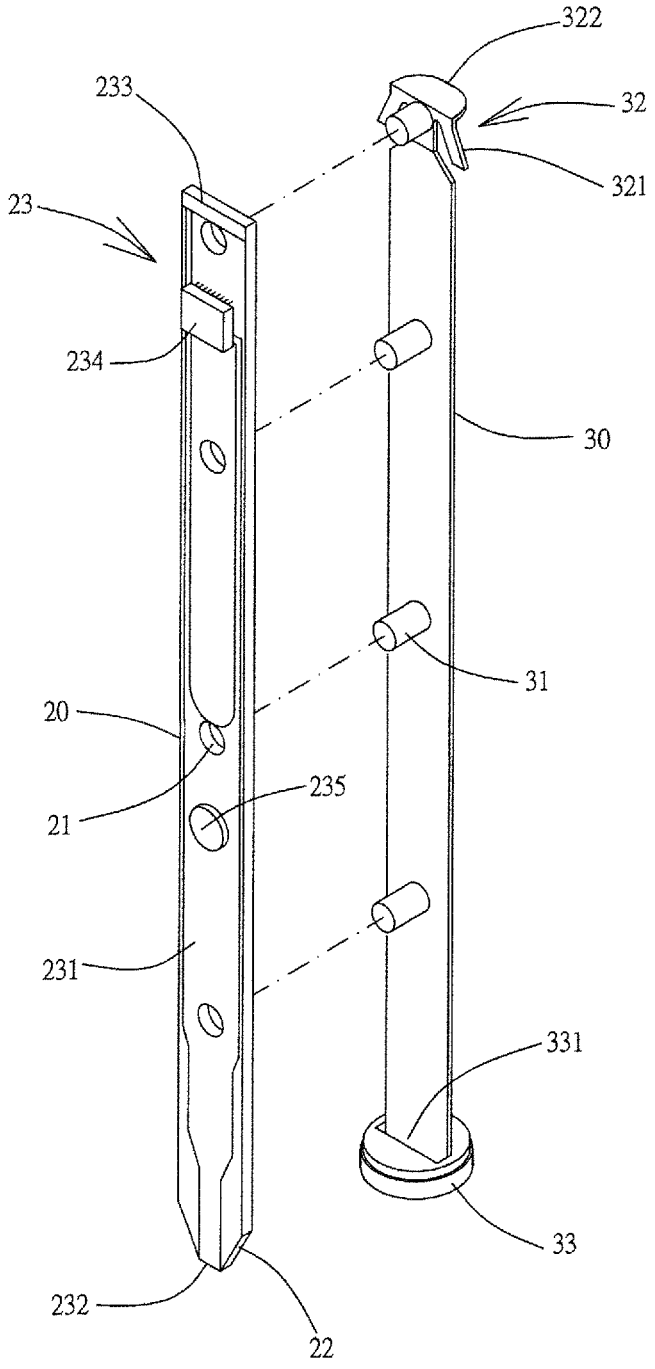
FIG. 4 is a perspective diagram showing the attachment of a circuit board to an insulating piece of the electronic bolt seal of FIG. 3.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 3 to 8*a*, an electronic bolt seal according to an embodiment of the present invention contains a bolt assembly A and a seal body B. The bolt assembly A is plugged axially downward into the seal body B when locking a door latch C. The seal body B and the door latch C are based on existing art and their details are omitted. The gist of the present invention lies in the bolt assembly A which contains the following components.

The bolt assembly A has an electrically conductive casing 10 which contains a bolt body 11, a bolt head 12 at a top end of the bolt body 11, a channel 13 running axially downward through the bolt head and the bolt body 11, and a ring 14 threaded through by the bolt body 11 and rested against the bolt head 12. The bolt body 10 has a smaller diameter than that of a latch hole C1 of the door latch C, which in turn is smaller than the bolt head 12's diameter so that the bolt body 11 can threads through the latch hole C1 until the bolt head 12 is blocked by the latch hole C1. The channel 13 contains a ring section 13B and a chamber section 13A, sequentially arranged along a top segment of the channel 13. The ring section 13B has a larger diameter than that of the chamber section 13A, which in turn is not less than that of the latch hole C1. The chamber section 13A thereby forms a first blocking element of the casing 10. The ring section 13B is to receive a top cover 15 for sealing a top end of the channel 13. A first fastening element 16 is configured around a circumference of a bottom portion of the bolt body 11. A top portion of the casing 10, the ring 14, and the top cover 15 are all wrapped inside a plastic waterproof cover 17. The bolt body 11 and the ring 14 jointly allow the casing 10 to rest reliably in the latch hole C1 so that, during the transportation of a container, the seal body B does not dangle and collide against the container door, thereby enhancing the life and performance of the electronic bolt seal. A bottom edge of the cover 17 has a downward extended wedge 171.

The bolt assembly A further contains an elongated circuit board 20 housed in the channel 13. The circuit board 20 has a number of through holes 21, a converging bottom end 22, and a control circuit 23 on a front surface. The control circuit 23 contains a wire layout 231, a bottom contact 232 connected to the wire layout 231, a top contact 233 connected to the wire layout 231, an RFID chip 234 on the wire layout 231, a battery 235 powering the RFID chip 234. The bottom contact 232 is at a tip of the converging bottom end 22, whereas the top contact 233 is at a top end of the circuit board 20. The bolt assembly A further contains an insulating piece 30 which has a number of pins 31 extended from a front surface and threading through the through holes 21 of the circuit board 20. The circuit board 20 is as such attached to the insulating piece 30 and the two are jointly housed inside the channel 13. A second blocking element 32 and a third blocking element 33 are configured on a top end and a bottom end of the insulating piece 30, respectively. The second blocking element 32 contains two lower elastic pieces 321 forked downward and a bended upper elastic piece 322. The lower elastic pieces 321 elastically contact a bottom side of the chamber section 13A and the upper elastic piece 322 elastically contacts a bottom side of the top cover 15. Through the upper and lower elastic pieces 322 and 321, the insulating piece 30 and the circuit board 20 are elastically suspended and limited in the channel 13, and do not fall off through the channel 13. In the meantime, the top contact 233 is below the upper elastic piece 322 and does not electrically contact the top cover 15. The casing 10 therefore cannot function as an external antenna electrically connecting the RFID chip 234. The third blocking element 33 is located below the channel 13 and has a greater diameter than that of the channel 13. The third blocking element 33 has a slot 331 for the converging bottom end 22 to penetrate through so that the bottom contact 232 is slightly exposed from a bottom side the third blocking element 33.

Figure 5:
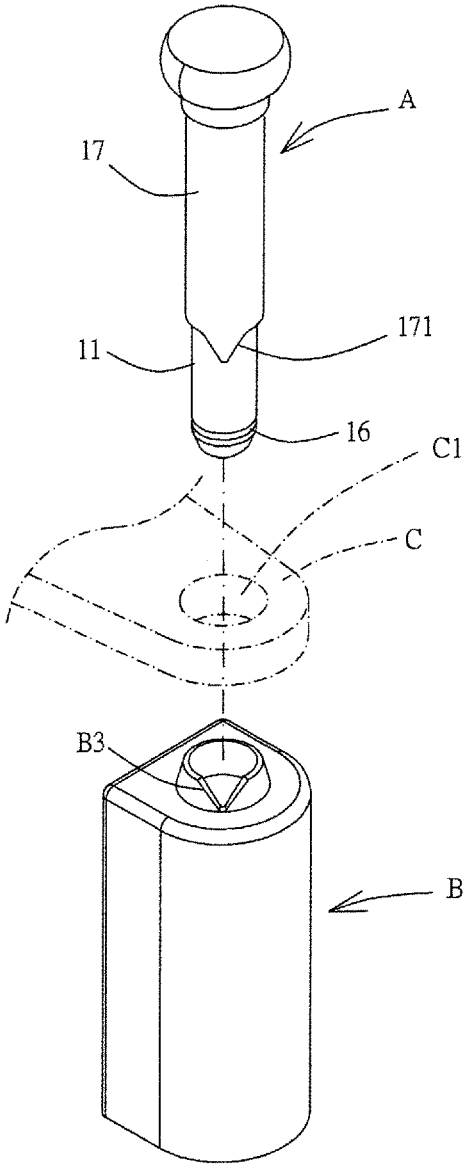
FIG. 5 is a perspective diagram showing a bolt assembly and a seal body of the electronic bolt seal of FIG. 3 before the bolt assembly is plugged into the seal body through a latch.
Figure 6:
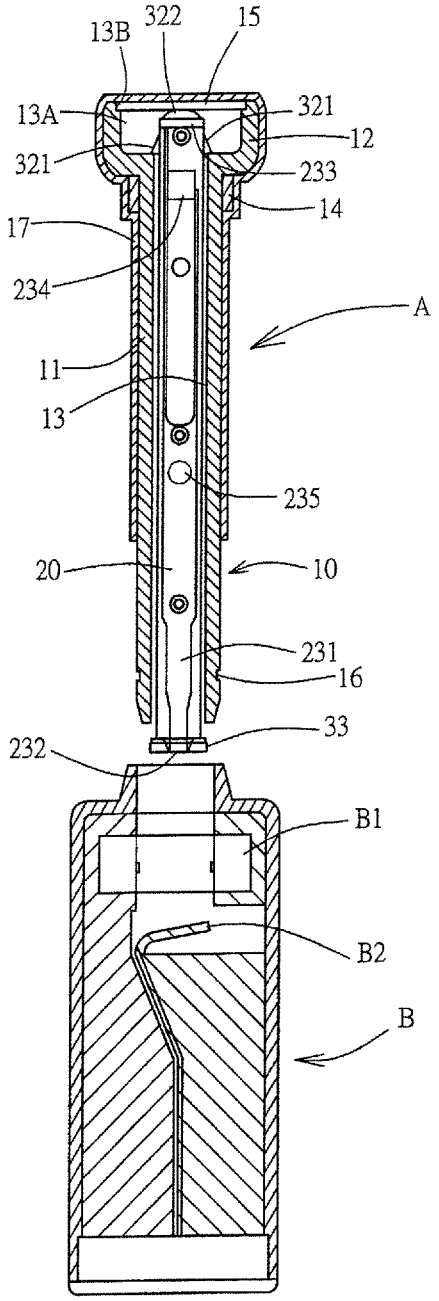
FIG. 6 is a sectional diagram showing the bolt assembly and the seal body of FIG. 5.
Figure 7:
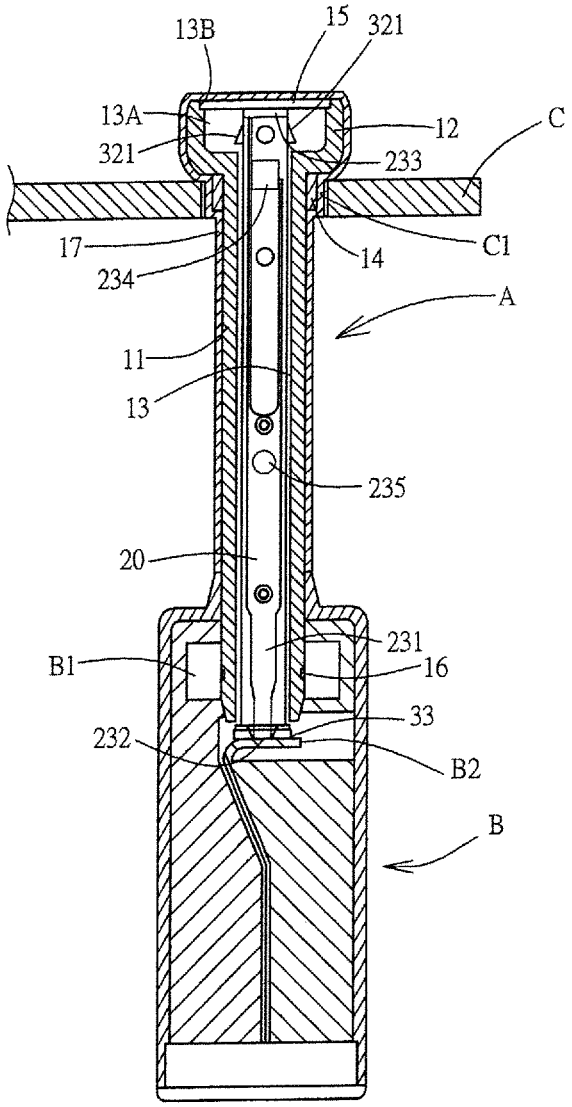
FIG. 7 is a sectional diagram showing the bolt assembly and the seal body of FIG. 5 after the bolt assembly is plugged into the seal body through the latch.

As illustrated in FIGS. 5, 6, and 7, the bolt assembly A is plugged into the seal body B through the latch hole C1 of the door latch C. The first fastening element 16 engages a second fastening element B1 in the seal body B and the bolt assembly A cannot be unplugged, thereby locking the door latch C. In the meantime, the third blocking element 33 presses an internal antenna B2 inside the seal body B and the bottom contact 232 contacts the internal antenna B2. The RFID chip 234 as such is electrically connected with the internal antenna B2 inside the seal body B. On the other hand, the top contact 233 is moved upward to contact the top cover 15. The casing 10 therefore is electrically connected with the RFID chip 234 and functions as an external antenna. The electronic bolt seal is then in operation. In addition, the seal body B has a notch B3 matching the wedge 171 of the plastic cover 17 so that the bolt assembly A after being plugged into the seal body B cannot be turned, thereby securing the bottom contact 232's reliable contact with the internal antenna B2.

Figure 8:
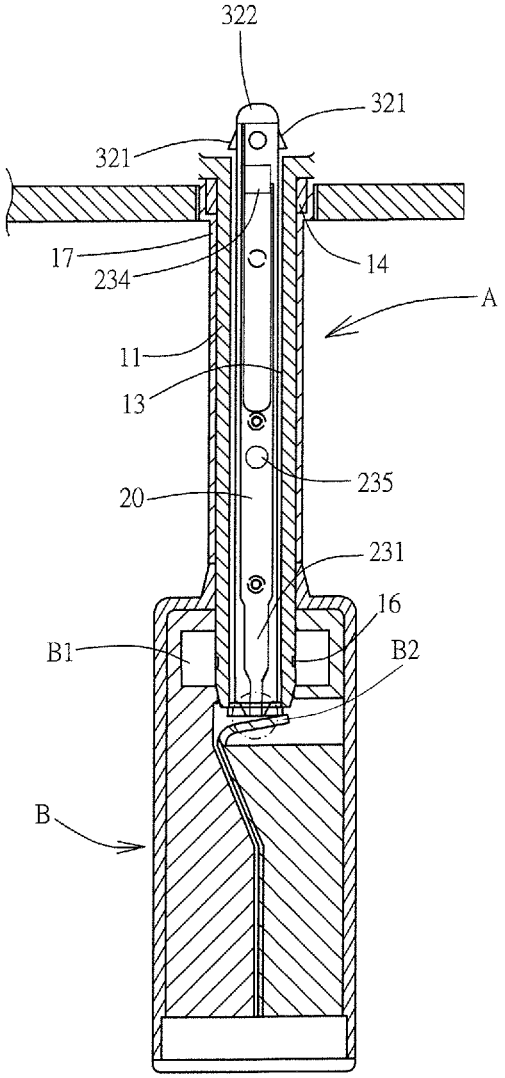
FIG. 8 is a sectional diagram showing the bolt assembly and the seal body of FIG. 5 after the bolt assembly is tampered.
Figure 8A:
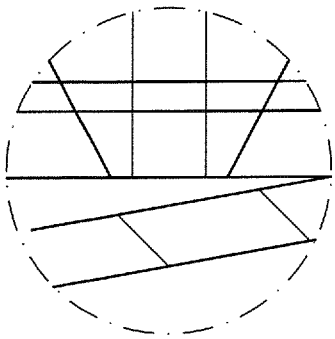
FIG. 8*a* is a sectional enlarged diagram showing a portion of FIG. 8.

As shown in FIGS. 7 and 8, if a burglar grind the bolt head 12 to a diameter smaller than that of the latch hole C1, the chamber section 13A would be destroyed and the top cover 15 would fall off from the bolt assembly A. The top contact 233's electrical connection with the top cover 15 is therefore interrupted and the casing 10 would fail to function as the external antenna for the RFID chip 234. Moreover, the top cover 15's falling off releases a pressure on the bottom contact 232's pressing the internal antenna B2. Also due to the internal antenna B2's resilience, the third blocking element 33 breaks the electrical connection between the bottom contact 232 and the internal antenna B2. As described, both the external antenna and the internal antenna B2 would fail to receive the electromagnetic wave from a reader, and fail to radiate the identification code from the RFID chip 234. The reader (e.g., operated by the customs) therefore can be altered.

Please note that the insulating piece 30 can be simplified if the second and third blocking elements 32 and 33 are riveted or bolted to the top and bottom ends of the circuit board 20, respectively.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electronic bolt seal for locking a comprising seal body and a bolt assembly plugged into the seal body through a latch hole of a latch so as to lock the latch, wherein the bolt assembly comprises an electrically conductive casing and a circuit board;

the bolt assembly comprises a bolt body, a bolt head at a top end of the bolt body, a channel running axially downward through the bolt head and the bolt body, and a first fastening element around a circumference of a bottom portion of the bolt body;

the channel comprises a chamber section in a top segment of the channel; the chamber section has a diameter not less than that of the latch hole; a top cover seals a top end of the channel; a top portion of the casing is wrapped inside a plastic waterproof cover;

the circuit board is housed in the channel; the circuit board comprises a control circuit on a front surface; the control circuit comprises a wire layout having a bottom contact, a top contact, and a radio-frequency identification (RFID) chip; when the bolt assembly is plugged into the seal body and cannot escape due to the first fastening element engaging the seal body, the bottom contact electrically connects the radio-frequency identification (RFID) chip to an internal antenna of the seal body; the top contact is moved upward to contact the top cover so that the casing functions as an external antenna to the radio-frequency identification (RFID) chip; and, when the bolt head is ground to a diameter smaller than that of the latch hole, the electrical connection between the top contact and the top cover is broken.

2. The electronic bolt seal according to claim 1, wherein a bottom end of the circuit board is configured with a third blocking element below a bottom end of the channel; the third blocking element has a larger diameter than that of the channel; a top end of the circuit board is configured with a second blocking element comprising an upper elastic piece against the top cover, a lower elastic piece against a bottom side of the chamber section so that the circuit board is suspended elastically in the channel and the top contact is prevented from electrically contacting the top cover; when the bolt assembly is plugged into the seal body and cannot escape due to the first fastening element engaging the seal body, the top contact is moved upward to contact the top cover.

3. The electronic bolt seal according to claim 2, wherein the bottom contact is exposed out of a bottom side of the third blocking element so that, when the bolt assembly is plugged into the seal body, the third blocking element presses the internal antenna and the bottom contact contacts the internal antenna; if the bolt head is ground to a diameter smaller than that of the latch hole, electrical connection of the top contact with the top cover is interrupted; a pressure on the bottom contact pressing the internal antenna is released; due to resilience of the internal antenna, the third blocking element breaks the electrical connection between the bottom contact and the internal antenna.

4. The electronic bolt seal according to claim 3, wherein the bolt assembly further comprises an insulating piece; the circuit board is attached to the insulating piece; the upper elastic piece, the lower elastic pieces, and the third blocking element are configured on the insulating piece; and the third blocking element has a slot for the bottom contact to pass through.

5. The electronic bolt seal according to claim 3, wherein the bottom end of the circuit board is a converging bottom end; and the bottom contact is at a tip of the converging bottom end.

6. The electronic bolt seal according to claim 3, wherein the casing further comprises a ring threaded through by the bolt body, rested against the bolt head, and wrapped in the plastic waterproof cover; the bolt body and the ring jointly allow the casing to rest reliably in the latch hole.

7. The electronic bolt seal according to claim 3, wherein a bottom edge of the plastic waterproof has a downward extended wedge; the seal body has a notch matching the wedge of the plastic waterproof cover so that the bolt assembly after being plugged into the seal body cannot be turned.

8. The electronic bolt seal according to claim 2, wherein the casing further comprises a ring threaded through by the bolt body, rested against the bolt head, and wrapped in the plastic waterproof cover; the bolt body and the ring jointly allow the casing to rest reliably in the latch hole.

9. The electronic bolt seal according to claim 2, wherein a bottom edge of the plastic waterproof has a downward extended wedge; the seal body has a notch matching the wedge of the plastic waterproof cover so that the bolt assembly after being plugged into the seal body cannot be turned.

10. The electronic bolt seal according to claim 1, wherein the electrically conductive casing further comprises a ring threaded through by the bolt body, rested against the bolt head, and wrapped in the plastic waterproof cover; the bolt body and the ring jointly allow the casing to rest reliably in the latch hole.

11. The electronic bolt seal according to claim 1, wherein a bottom edge of the plastic waterproof has a downward extended wedge; the seal body has a notch matching the wedge of the plastic waterproof cover so that the bolt assembly after being plugged into the seal body cannot be turned.

* * * * *